US008262742B2

(12) United States Patent
Self

(10) Patent No.: US 8,262,742 B2
(45) Date of Patent: Sep. 11, 2012

(54) REDUCTION OR PREVENTION OF DYE BLEEDING

(75) Inventor: Aaron Frank Self, Ringgold, GA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 93 days.

(21) Appl. No.: 11/982,871

(22) Filed: Nov. 6, 2007

(65) Prior Publication Data

US 2008/0127430 A1 Jun. 5, 2008

Related U.S. Application Data

(60) Provisional application No. 60/873,137, filed on Dec. 5, 2006.

(51) Int. Cl.
*D06P 5/02* (2006.01)
*C09B 67/00* (2006.01)

(52) U.S. Cl. ..... 8/442; 8/618; 8/680; 8/920; 8/929; 428/375; 428/378; 428/392

(58) Field of Classification Search ..... 8/115.51, 8/442, 512, 115.6, 181, 127.6, 115.58, 115.65, 8/539, 543, 618, 620, 680, 924, 929, 920; 428/375, 378, 392

See application file for complete search history.

(56) References Cited

U.S. PATENT DOCUMENTS

| | | | | |
|---|---|---|---|---|
| 4,501,591 | A | 2/1985 | Ucci et al. | |
| 4,619,853 | A | 10/1986 | Blyth et al. | |
| 4,680,212 | A | 7/1987 | Blyth et al. | |
| 5,030,246 | A * | 7/1991 | Chao | 8/618 |
| 5,085,667 | A | 2/1992 | Jenkins | |
| 5,108,684 | A | 4/1992 | Anton et al. | |
| 5,199,958 | A | 4/1993 | Jenkins et al. | |
| 5,242,733 | A | 9/1993 | Windley | |
| 5,252,375 | A | 10/1993 | Turbak et al. | |
| 5,340,886 | A * | 8/1994 | Hoyt et al. | 525/426 |
| 5,354,342 | A | 10/1994 | Jenkins | |
| 5,401,554 | A | 3/1995 | Armen | |
| 5,466,527 | A | 11/1995 | Jenkins | |
| 5,468,554 | A | 11/1995 | Windley | |
| 5,484,455 | A | 1/1996 | Kelley | |
| 5,571,290 | A | 11/1996 | Jenkins | |
| 5,651,794 | A | 7/1997 | Taylor | |
| 5,662,716 | A | 9/1997 | Sun | |
| 5,912,409 | A | 6/1999 | Jenkins | |
| 5,972,046 | A | 10/1999 | Hixson et al. | |
| 6,013,111 | A | 1/2000 | Jenkins | |
| 6,719,810 | B1 * | 4/2004 | Kelly et al. | 8/115.6 |
| 6,811,574 | B2 | 11/2004 | Baumann et al. | |
| 6,814,758 | B1 | 11/2004 | Pacifici et al. | |
| 2002/0144353 | A1 * | 10/2002 | Baumann et al. | 8/115.51 |

FOREIGN PATENT DOCUMENTS

| | | |
|---|---|---|
| JP | 61194282 | 8/1986 |
| JP | 01260061 | 10/1989 |
| JP | 07119036 | 5/1995 |
| WO | WO 91/14512 A | 10/1991 |

OTHER PUBLICATIONS

Fumishi et al, Dyeing of cationic dye-dyeable polyester fibers, Sen'I (1974), 26(6) 249-255. Abstract.

* cited by examiner

*Primary Examiner* — Bijan Ahvazi

(57) ABSTRACT

The present invention relates to a method of applying dye and stainblocker to a substrate comprising cationically dyeable fibers which reduces or eliminates the need for subsequent reapplication of dye. The present invention solves the problem of cationic dye removal resulting from stainblocker application by providing a method wherein application of stainblocker precedes the application of dye to a substrate comprising cationically dyeable fibers. Surprisingly, the invention provides a method wherein the effectiveness of cationic dye application is improved when preceded by stainblocker application compared to stainblocker application preceded by cationic dye application. The substrate comprising cationically dyeable fibers preferably further comprises acid dyeable fibers wherein even more preferably, said cationically dyeable fibers and acid dyeable fibers are attached to a backing to form a carpet.

13 Claims, No Drawings

REDUCTION OR PREVENTION OF DYE BLEEDING

FIELD OF THE INVENTION

The present invention relates to a method of applying dye and stainblocker to a substrate comprising cationically dyeable fibers which reduces or eliminates the need for subsequent reapplication of dye.

BACKGROUND OF THE INVENTION

Stainblockers are commonly applied to fibrous substrates to prevent stains. However, the use of stainblockers often interferes with the dyeing of fibrous substrates. Generally, because stainblockers provide resistance to staining, they also provide resistance to dyeing. Stainblockers may also undesirably interact with dye to cause bleeding or dye removal.

In general, there are two classes of dyeable fibers. One class of dyeable fibers, commonly referred to as "acid dyeable fibers," have cationic chemical functionalities which readily accept dyes with anionic chemical functionalities, also commonly referred to as acid dyes. A second class of dyeable fibers, commonly referred to as "cationic dyeable fibers," have anionic chemical functionalities which readily accept dyes with cationic chemical functionalities, also commonly referred to as basic dyes.

Typical stainblockers have anionic chemical functionalities which react with the cationic chemical functionalities of acid dyeable fibers thereby blocking sites where staining might occur. Unfortunately, typical stainblockers also block sites where dyeing can occur, especially where acid dyes are used. Accordingly, when stainblocker application precedes acid dye application, the dye is hindered from interacting with acid dyeable fibers thereby requiring additional applications of the dye. Therefore, with respect to acid dyes and dyeable fibers, it is conventional to proceed with dye application before applying stainblocker. One notable exception is U.S. Pat. No. 4,680,212, which discloses the application of a stainblocker and a fluorochemical during the manufacture of acid dyeable fibers. The resulting fibers are then dyed with acid dyes at elevated temperatures. While this reference, and perhaps other like it, address problems associated with application of stain blockers and dyes to acid dyeable fibers, unsolved problems remain regarding application of stainblockers and cationic dyes to cationically dyeable fibers.

Unfortunately, the anionic chemical functionalities of typical stainblockers often undesirably interact with the cationic chemical functionalities of cationic dyes. Consequently, the application of stainblocker after dye application causes removal of the dye, commonly known as "bleeding." One solution to the problem of dye bleeding is the subsequent reapplication of the dye as exemplified by U.S. Pat. No. 6,811,574. Nevertheless, it would be advantageous to find a method of applying cationic dye and stainblocker to cationically dyeable fibers which reduces or eliminates dye bleeding and the need for further reapplication of dye.

BRIEF SUMMARY OF THE INVENTION

The present invention solves the problem of cationic dye removal (dye bleeding) resulting from stainblocker application by providing a method wherein application of stainblocker precedes the application of dye to a substrate comprising cationically dyeable fibers. Surprisingly, the invention provides a method wherein dye bleeding is reduced or eliminated when cationic dye application is preceded by stainblocker application compared to stainblocker application preceded by cationic dye application. Hence, in this invention, at least one application of stainblocker application precedes any application of dye.

The substrate comprising cationically dyeable fibers preferably further comprises acid dyeable fibers wherein even more preferably, said cationically dyeable fibers and acid dyeable fibers are attached to a backing to form a carpet.

The stainblockers used in the present invention are preferably chosen from the group consisting of: a) a sulfonated phenolic resin or condensate, b) a partially sulfonated resin, c) a polymer or copolymer of acrylic/methacrylic acid or esters thereof, d) a copolymer of maleic anhydride with olefin or vinyl ether, e) a hydrolyzed ethylenically unsaturated aromatic/maleic anhydride copolymer, and combinations thereof.

The stainblocker is preferably applied by exhausting or depositing a solution or dispersion of the stainblocker onto the substrate. Even more preferably, the stainblocker is applied by immersing the substrate in bath comprising a solution or dispersion of the stainblocker wherein the fibrous substrate and bath are maintained at a temperature of at least 45° C. for at least 10 minutes while the substrate is immersed. The amount of stain blocker in the solution or dispersion is preferably from about 2.5 g/L to about 35 g/L. The amount of stainblocker in the solution or dispersion is preferably from about 5 to 30 percent based on the dry weight of the fibers in the substrate (OWF).

The dye used in the present invention comprises at least one cationic dye and more preferably further comprises at least one acid dye. The dye is preferably applied by immersing the substrate in a bath comprising a solution or dispersion of the dye wherein the substrate and bath are maintained at a temperature of at least 50° C. for at least 20 minutes while the substrate is immersed. The amount of dye in the bath is preferably from about 0.001 to about 5 weight percent based on the dry weight of the fibrous substrate (OWF). The pH of the bath is preferably from about 4.5 to about 8.0. After application of the dye, the substrate is preferably dried at a temperature of at least 82° C. for at least about 15 minutes.

DETAILED DESCRIPTION OF THE INVENTION

The present invention's method for reducing dye bleeding during the application of stainblocker and dye is useful for treating a variety of substrates comprised of cationically dyeable fibers. Such substrates include cationically dyeable fibers themselves and materials made with said fibers including fabrics, fabric blends, textiles, carpet and nonwovens. The term "fiber" includes fibers and yarns, before and after spinning, of a variety of compositions and forms. The term "fabrics" is meant to include natural or synthetic fabrics, or blends thereof, comprised of fibers such as cotton, rayon, silk, wool, polyester, polypropylene, polyolefins, nylon, and aramids such as "NOMEX" and "KEVLAR." The term "fabric blends" is meant to include a fabric made of two or more types of fibers. Carpets include for example those comprised of cotton, wool, silk, nylon, acrylics, aromatic polyamides, polyesters, jute, sisal, and other cellulosics.

In particular, the present invention's method for applying stainblocker and dye is especially useful for a substrate comprising cationically dyeable and further comprising acid dyeable fibers wherein said cationically dyeable fibers and acid dyeable fibers are attached to a backing to form a carpet. Preferably, the substrate comprises fibers made from nylon such as type 6 nylon and/or type 6,6 nylon.

Stainblockers suitable for use in the invention include commercially available stainblockers, or blends thereof, or other stainblockers known in the art. These comprise a sulfonated phenolic resin or condensate, a partially sulfonated resin, a polymer or copolymer of acrylic/methacrylic acid or esters thereof, a copolymer of maleic anhydride with olefin or vinyl ether, a hydrolyzed ethylenically unsaturated aromatic/maleic anhydride copolymer, and combinations thereof. Examples are disclosed in U.S. Pat. Nos. 5,851,595 and 6,613,862. Suitable stain resist agents include dispersions of a blend of hydrolyzed maleic anhydride copolymers, sulfonated phenolic resins, and surfactants, prepared as in U.S. Pat. Nos. 4,883,839; 4,948,650 and 5,032,136. Other suitable stainblockers include a hydrolyzed ethylenically unsaturated aromatic/maleic anhydride copolymer, or a copolymer of an olefin or a vinyl ether with maleic anhydride are preferred. Also suitable is a dispersion of a blend of hydrolyzed maleic anhydride copolymers, sulfonated phenolic resin, aqueous solution of a partial sodium salt of a hydrolyzed octene/maleic anhydride copolymer, and surfactant as disclosed in U.S. Pat. No. 5,654,068.

An example of a preferred stain resist agent is a dispersion of a sulfonated phenol-formaldehyde condensation product as disclosed and prepared as in U.S. Pat. No. 4,833,009. Other suitable stain resist agents (or stain blockers) for use herein include those disclosed by Scholla comprising hydrolyzed vinyl aromatic-maleic anhydride polymers and hydrolyzed styrene maleic anhydride polymers in U.S. Pat. No. 5,096,747. Pechhold, in U.S. Pat. No. 5,460,887, described styrene/maleic anhydride copolymer and similar stain resist compositions also suitable for use in the present invention. Partially sulfonated resins as prepared in U.S. Pat. No. 4,875,901 and EP 797699 are also useful herein. Additional suitable stain resist agents include those of Pechhold in U.S. Pat. No. 5,712,348 disclosing maleic acid copolymers with fluorinated thioether end-caps and U.S. Pat. No. 6,238,792 disclosing maleic acid terpolymers. Especially preferred stain resist agents include sulfonated phenolic condensation products, hydrolyzed copolymers of maleic anhydride with at least one ethylenically-unsaturated comonomer such as a partial sodium salt of a hydrolyzed octene/maleic anhydride copolymer, or blends thereof.

Stainblocker compositions useful in the present invention are commercially available from E.I. Du Pont de Nemours and Company, Wilmington, Del., under the trademarks SR 300, SR 400 and SR 500; from Du Pont de Nemours International S. A., Geneva, Switzerland, under the trademark NRD; from Allied Colloids, Bradford/West Yorkshire, U.K., under the trademark ALGUARD RD; from Bayer AG, Leverkusen, Germany, under the trademark BAYGUARD DT; and from Mobay Chemical Corp., Pennsylvania, under the trademark MESITOL NBS.

So long as at least one stainblocker application precedes any application of dye, stainblocker may be suitably applied by a process in which the stainblocker is exhausted or deposited onto the substrate. The present invention comprises the use of a solution of the stainblocker, optionally with other additives, in a bath or other treatment medium. The stainblocker is preferably applied to the substrate using an exhaust method, such as a Beck or Winch method. However, the stainblocker may be applied by other application methods known in the art. These include continuous methods such as, but not limited to, flex-nip, pad, spray, or foam application.

The amount of stainblocker employed is an amount sufficient to provide a concentration of from about 2.5 g/L to about 35 g/L in the bath or other treating medium. Preferably, the concentration is from about 5 g/L to about 30 g/L, more preferably from about 11 g/L to about 30 g/L, and even more preferably from about 15 g/L to about 25 g/L. The present invention also contemplates combinations of one or more stainblockers.

Conventional bath conditions can be used. For example, for an exhaust application, an application period of from about 5 minutes to about 30 minutes and preferably about 15 minutes is employed. The weight ratio of bath to dry fiber is suitably from about 40:1 to about 2:1. A bath pH of from about 1 to about 9, preferably about 1.5 to about 5.0, and more preferably about 1.8 to about 3.0 is used. The bath temperature is from about 160° F. to about 200° F. (from about 71° C. to about 93° C.), and preferably about 190° F. (about 88° C.). Lower pH and higher temperature improve exhaust efficiency but the more extreme conditions may adversely effect equipment. These conditions are balanced with operating and maintenance costs. After application of the composition of the present invention, the substrate is rinsed and then subjected to dye application.

Dyes suitable for use in the present invention include acid dyes, cationic dyes, and mixtures thereof. Suitable acid dyes include anionic dyes containing acidic groups such as monoazo and anthraquinone dyes. Examples of commercially available acid dyes are sold under the trademark TECTILON and are available from Ciba Specialty Chemicals Corporation, High Point, N.C. Suitable cationic dyes include basic dies containing amine or amide groups usually in the form of heterocylic compounds. Examples of commercially available cationic dyes are sold under the trademark SEVRON from Crompton & Knowles, Gibraltar, Pa.; and sold under the trademark MAXILLON from Ciba Specialty Chemicals Corporation, High Point, N.C.

In accordance with the invention, dye may be applied by dissolving the dye in water thereby creating an aqueous dye bath. A surfactant, typically a nonionic surfactant, can also be used to aid in dispersing sparingly water-soluble disperse dyes in a dye bath. Dye baths typically have a pH value in the range from about 2 to about 11. In a preferred embodiment of the invention, a mixture of at least one cationic dye and at least one acid dye is used wherein the preferred pH is between 5.0 and 7.0, more preferably 5.0 to 6.0, and most preferably 5.2 to 5.8. The pH may be adjusted, if desired, using a variety of compounds, such as formic acid, acetic acid, sulfamic acid, citric acid, phosphoric acid, nitric acid, sulfuric acid, monosodium phosphate, trisodium phosphate, sodium carbonate, sodium bicarbonate, ammonium hydroxide, sodium hydroxide, or a combination thereof.

The substrate is immersed in the dye bath for a sufficient period of time to allow the dye to be adsorbed onto the surface of the substrate and for dye molecules to attach themselves to the substrate. Immersion times vary depending upon the particular dye or dyes used but are typically from about 30 to about 120 minutes. During immersion, the dye bath may be agitated to hasten the dyeing rate. The dyeing step can be carried out at a variety of temperatures, depending upon the dye or dyes used. However, because the dyeing step of the invention is preceded by application of stainblocker, higher temperatures (e.g., about 88 to about 100° C.) are typically preferred to promote the rate of dyeing. After immersion of the substrate, dry heat is preferably applied at a temperature and period of time to cause the dye to penetrate into, and become fixed in, the substrate. The fixation temperature and period of time are dependent upon each other in that higher temperatures require less time but are also dependent upon the dye or dyes used. However, the fixation step is typically conducted at a temperature of from about 82° C. to about 100° C. for a period of at least 15 minutes.

EXAMPLES

The following are illustrative examples and should not be construed to unduly limit the scope and spirit of the claimed invention. Words which indicate trademarks are displayed with all capital letters.

Carpet Substrate

The carpet used in all of the following examples was an un-dyed tufted carpet with a 28 oz/yd$^2$ (1 kg/m$^2$) level loop construction available under the trademark ANTRON LEGACY available from Invista of Wichita, Kans. The fibers used in the construction of the carpet were a combination of denier acid dyeable and cationic dyeable nylon. The fibers were twisted at 5.5 turns per inch (per 2.54 cm) and Superba heatset at 265° F.

Stain blocker Application

Procedures for application of stainblocker for all the Examples were performed in the following manner. An application bath was prepared with water and addition of a stainblocker in a percentage quantity based upon the dry weight of the fibers (OWF) as indicated in the table below. The pH of the application bath was adjusted with AUTOACID A-10 (available from Peach State Labs, Inc., Rome, Ga.) to a level indicated in the table below. The composition was applied to carpet by an exhaust method with bath to dry fiber weight ratio (BF Ratio) indicated in the table below. The application bath and carpet were brought up to a temperature (° C.) as indicated in the table below and held for 20 minutes.

TABLE 1

| | Example Number | | | |
|---|---|---|---|---|
| | 1A/1B | 2A/2B | 3A/3B | 4A/4B |
| Stainblocker | NRD-623 | Mesitol NBS Liquid | TLF-9912 | Mesitol NBS Liquid |
| OWF | 2.4 | 5.9 | 1.9 | 11.7 |
| pH | 2.5 | 4.5 | 3.0 | 4.5 |
| BF Ratio | 25:1 | 21:1 | 25:1 | 21:1 |
| ° C. | 90 | 90 | 88 | 90 |

Dye Application

Procedures for application of dye for all the Examples were performed in the following manner. The carpet was dyed by an exhaust method with a specified bath to dry fiber weight ratio (BF Ratio) indicated in the table below. The carpet was dyed using the dye composition indicated in the table below. Dye auxiliaries were added first, followed by cationic dyes. The pH of the dye bath was adjusted to 5.5 with 56% Acetic Acid. The dye bath temperature was brought up to 212° F. (100° C.) and held for 45 minutes.

TABLE 2

| | | | Example Number | | | |
|---|---|---|---|---|---|---|
| | | | 1A/1B/1C | 2A/2B/2C | 3A/3B/3C | 4A/4B/4C |
| | BF Ratio | | 25:1 | 21:1 | 25:1 | 21:1 |
| Dye composition by percent OWF | Dye auxiliaries | DOWFAX 2A4 | 0.5 | 0.5 | 0.5 | 0.5 |
| | | MAYOQUEST | 0.2 | 0.2 | 0.2 | 0.2 |
| | | Sodium Thiosulfate | 0.02 | 0.02 | 0.02 | 0.02 |
| | | ULTRAGEN 132-N | 1.0 | 0.5 | 0.5 | 0.5 |
| | Cationic Dyes | TECTILON Yellow 3R | 0.0208 | 0.0208 | 0.0208 | 0.0208 |
| | Anionic Dyes | TECTILON Red 2B | 0.0123 | 0.0123 | 0.0123 | 0.0123 |
| | | TECTILON Blue 4R | 0.0198 | 0.0198 | 0.0198 | 0.0198 |
| | | MAXILLON Yellow GL | 0.00166 | 0.00166 | 0.053 | 0.00166 |
| | | SEVRON Red YCN | 0.0228 | 0.0228 | 0.0233 | 0.0228 |
| | | SEVRON Blue NCN | 0.0446 | 0.0446 | 0.0156 | 0.0446 |

DOWFAX 2A4 is a surfactant is available from Dow Chemical Company, Midland, Mich. MAYOQUEST is a commercial sodium ethylene-diamine-tetra-acetate (EDTA) solution from Callaway Chemical Co., Smyrna, Ga. Sodium thiosulfate is added to prevent chlorine ions from interacting with the cationic dyes. ULTRAGEN is an anti-precipitant commercially available from Manufacturers Chemicals, Dalton, Ga. TECTILON Yellow 3R, TECTILON Red 2B, TECTILON Blue 4R are acid dyes commercially available from Ciba Specialty Chemicals Corporation, High Point, N.C. MAXILLON is a cationic dye available from Ciba Specialty Chemicals Corporation, High Point, N.C. SEVRON Red YCN and SEVRON Blue NCN are cationic dyes available from Crompton & Knowles, Gibraltar, Pa.

Example 1A

Stainblocker was applied prior to dye application in the following manner. Stainblocker was applied to the carpet. The carpet was rinsed. Dye was applied to the carpet. The sample was rinsed and centrifuged. The sample was then oven dried at 180° F. for 15 minutes.

Example 1B

The conditions of Example 1A were repeated on a separate carpet except that dye was applied prior to stainblocker application in the following manner. The carpet was dyed. The carpet was rinsed. Stainblocker was applied to the carpet. The sample was rinsed and centrifuged. The sample was then oven dried at 180° F. for 15 minutes.

Example 1C

Only dye was applied. The sample was rinsed and centrifuged. The sample was then oven dried at 180° F. for 15 minutes.

Example 2A

Stainblocker was applied prior to dye application in the following manner. Stainblocker was applied to the carpet.

The sample was rinsed. Dye was applied to the carpet. The sample was rinsed and centrifuged. The sample was then oven dried at 180° F. for 15 minutes.

Example 2B

The conditions of Example 2A were repeated on a separate carpet except that dye was applied prior to stainblocker application in the following manner. The carpet was dyed. The carpet was rinsed. Stainblocker was applied to the carpet. The sample was rinsed and centrifuged. The sample was then oven dried at 180° F. for 15 minutes.

Example 2C

Only dye was applied. The sample was rinsed and centrifuged. The sample was then oven dried at 180° F. for 15 minutes.

Example 3A

Stainblocker was applied prior to dye application in the following manner. Stainblocker was applied to the carpet. The sample was rinsed. Dye was applied to the carpet. The sample was rinsed and centrifuged. The sample was then oven dried at 180° F. for 15 minutes.

Example 3B

The conditions of Example 3A were repeated on a separate carpet except that dye was applied prior to stainblocker application in the following manner. The carpet was dyed. The carpet was rinsed. Stainblocker was applied to the carpet. The sample was rinsed and centrifuged. The sample was then oven dried at 180° F. for 15 minutes.

Example 3C

Only dye was applied. The sample was rinsed and centrifuged. The sample was then oven dried at 180° F. for 15 minutes.

Example 4A

Stainblocker was applied prior to dye application in the following manner. Stainblocker was applied to the carpet. The sample was rinsed. Dye was applied to the carpet. The sample was rinsed and centrifuged. The sample was then oven dried at 180° F. for 15 minutes.

Example 4B

The conditions of Example 4A were repeated on a separate carpet except that dye was applied prior to stainblocker application in the following manner. The carpet was dyed. The carpet was rinsed. Stainblocker was applied to the carpet. The sample was rinsed and centrifuged. The sample was then oven dried at 180° F. for 15 minutes.

Example 4C

Only dye was applied. The sample was rinsed and centrifuged. The sample was then oven dried at 180° F. for 15 minutes.

Testing

All of the treated carpets in the foregoing examples were subjected to KOOL-AID soft drink stain resistance test using a procedure based on the American Association of Textile Chemists and Colorists (AATCC) Method 175, "Stain Resistance: Pile Floor Coverings." A staining solution was prepared by mixing sugar sweetened cherry KOOL-AID (36.5 g) and 500 mL water. KOOL-AID is a trademark of Kraft General Foods, Inc., White Plains N.Y. A 15 cm by 15 cm carpet sample was placed on a flat non-absorbent surface and a hollow plastic cylinder having a 2-inch (5-cm) diameter was placed tightly over the carpet sample. KOOL-AID staining solution (20 mL) was poured into the cylinder, which had been previously placed on the carpet sample. The stain was gently worked into the carpet. The cylinder was then removed and the stained carpet sample was allowed to sit undisturbed for 24 hours. Then the carpets were rinsed thoroughly under cold tap water for at least 10 minutes until the rinse water was clear. The carpet samples were extracted, and air-dried for 24 hours on a non-absorbent surface. The KOOL-AID stains obtained by this procedure were rated either with a visual stain rating scale (AATCC Red 40 Stain Scale) from AATCC Test Method 175 or using a measurement of delta E color difference. A visual rating of 10 (complete stain removal) to 1 (maximum or unchanged stain) was obtained by using the MTCC Red 40 Stain Scale (Test Method #175) with the KOOL-AID stains having the same discoloration as the numbered colored film. Using this scale, a higher number indicates superior stain resistance.

All of the treated carpets in the forgoing examples were subjected to the following mustard stain resistance test. A 2-inch (5.1 cm) brass ring was placed in the center of a 4-6 inch (10.2-15.3 cm) square sample of carpet which was on a non-absorbent surface. French's yellow mustard (15 g, from Reckitt Benckiser, Inc., Wayne N.J.) was used to create a stain by placing the mustard in the middle of the brass ring on the carpet, and then spreading and pressing the stain into the carpet surface. After setting for 24 hours, the excess mustard was (a) scraped off, (b) thoroughly rinsed with water, (c) extracted, and (d) air-dried for 24 hours on a non-absorbent surface. Mustard stains were then rated with a visual stain rating scale (AATCC Red 40 Stain Scale) from AATCC Test Method 175. A visual rating of 10 (complete stain removal) to 1 (maximum or unchanged stain) was used that approximated the MTCC Red 40 Stain Scale (Test Method #175) with the mustard stains having the same discoloration as the numbered colored film, though discoloration of the mustard stain was yellow while the discoloration of AATCC Red 40 Stain Scale was red. On this scale, a higher number indicates superior stain resistance.

For all of the examples 1-4, the color difference of subset A versus subset C and the color difference between subset B and C was measured by obtaining Gray Scale ratings with a visual rating scale (AATCC Gray Scale for Color Change) from MTCC Test Method 178. A visual rating of 5 (the least color difference) to 1 (the most color difference) was obtained using the AATCC Gray Scale for color change (MTCC Evaluation Procedure 1). On this scale, a grade of 5 is given if there is no perceived difference in color or contrast before and after treatment, while a grade of 1 is given for the most perceived difference.

For all of the examples 1-4, the color difference of subset A versus subset C and the color difference between subset B and C was measured by obtaining a delta E number. The color of the carpet (L*, a*, b*) was measured on a carpets of subset A, B, and C. The color difference was measured using a Minolta CHROMA METER CR-410 (Minolta Corporation, Ramsey N.J.). Color readings were taken on several areas on the carpet sample and the averaged. The difference between the measured color of subset A versus C is expressed as delta E and is shown in Table 3. The difference between the measured color of subset B versus C is expressed as delta E and is shown in Table 3. A delta E reading of zero represents no color difference with a larger delta E value indicates a greater color difference. Color measurement with delta E is discussed in AATCC Evaluation Procedure 7 "Instrumental Assessment of the Change in Color of a Test Specimen". Using this evaluation, a lower delta E indicates a more effective dye application.

Table 3 shows the testing results of examples 1-4. Each example includes three subsets. In subset A, application of stainblocker was performed prior to application of dye. In subset B, the conditions of subset A were repeated except that application of dye was performed prior to application of stain resist. In subset C, only the application of dye was performed under the same conditions as subsets A and B.

In subset C, where only dye is applied, the stain resistance to KOOL-AID and Mustard is expectedly poor compared to subsets A and B, where stainblocker is applied. Comparing subsets A and B shows that the application sequence of stainblocker and dye has little or no influence upon imparting acceptable stain resistance to KOOL-AID and Mustard. However, the application sequence of stainblocker and dye greatly influences the color change as shown by Gray Scale and Delta E tests.

When stainblocker is applied prior to dye, as in subset A, the color achieved is similar compared to the color achieved from dye application only as evidenced by higher Gray Scale and lower Delta E numbers. This indicates that when stainblocker is applied prior to dye, as in subset A, little or no dye bleeding occurs. When dye is applied prior to stainblocker, as in subset B, the color is very different compared to the color achieved from dye application only, as evidenced by lower Gray Scale and higher Delta E numbers. This indicates that when dye is applied prior to stainblocker, as in subset B, significant dye bleeding occurs. Therefore, compared to subset A, subset B would more likely require additional dye application (because of dye bleeding) to resemble the color achieved from dye application only.

Subset A shows that dye is more effectively retained by the substrate when stainblocker precedes dye application because there is virtually no difference in color compared to color achieved from dye application only. Gray Scale numbers close to 5 and Delta E numbers close to zero indicate this small color difference. This small color difference indicates that when stainblocker is applied prior to dye, as in subset A, little or no dye bleeding occurs. Subset B shows that dye is less effectively retained by the substrate when dye precedes stainblocker application because there a large difference in color compared to color achieved from dye application only. This large difference in color indicates that when dye is applied prior to stainblocker, as in subset B, significant dye bleeding occurs. Therefore, applying stainblocker before dye rather than vice versa reduces dye bleeding and the need for additional application of dye.

TABLE 3

| | | Testing Procedure | | | |
|---|---|---|---|---|---|
| | Type of Application | Kool-Aid | Mustard | Gray Scale | Delta E |
| Example Number | 1A stainblocker first | 10 | 4 | 4-5 | 0.58 |
| | 1B dye first | 10 | 7 | 2-3 | 4.97 |
| | 1C dye only | 1 | 1 | — | — |
| | 2A stainblocker first | 10 | 4 | 4-5 | 0.72 |
| | 2B dye first | 10 | 8 | 2-3 | 3.76 |

TABLE 3-continued

| | Testing Procedure | | | |
|---|---|---|---|---|
| Type of Application | Kool-Aid | Mustard | Gray Scale | Delta E |
| 2C dye only | 1 | 1 | — | — |
| 3A stainblocker first | 10 | 4 | 4-5 | 1.29 |
| 3B dye first | 10 | 10 | 1-2 | 8.72 |
| 3C dye only | 1 | 1 | — | — |
| 4A Stainblocker first | 10 | 6 | 4-5 | 0.88 |
| 4B dye first | 10 | 8.5 | 2 | 6.24 |
| 4C dye only | 1 | 1 | — | — |

What is claimed is:

1. A method of treating a substrate comprising:

a) applying at least one stainblocker in a solution or dispersion to a substrate comprising cationically dyeable fibers and acid dyeable fibers, wherein the amount of stainblocker in said solution or dispersion is from about 5 to about 30% on weight fiber;

b) applying at least one dye comprising at least one cationic dye and at least one acid dye wherein step a) is performed prior to applying any dye, and c) fixing said dye by using dry heat to produce a dyed stainblocker-treated substrate, and wherein dye bleeding of said substrate is reduced or eliminated compared to a substrate for which dye application has preceded stainblocker application.

2. The method of claim 1, wherein the stainblocker is chosen from the group consisting of: a) a sulfonated phenolic resin or condensate, b) a partially sulfonated resin, c) a polymer or copolymer of methacrylic acid or esters thereof, d) a copolymer of maleic anhydride with olefin or vinyl ether, e) a hydrolyzed ethylenically unsaturated aromatic/maleic anhydride copolymer, and combinations thereof.

3. The method of claim 1, wherein the stainblocker is applied by exhausting or depositing a solution or dispersion of the stainblocker onto the substrate.

4. The method of claim 1, wherein the stainblocker is applied by immersing the substrate in bath comprising a solution or dispersion of the stainblocker.

5. The method of claim 3, wherein the amount of stain blocker in the solution or dispersion is from about 2.5 g/L to about 35 g/L.

6. The method of claim 5, wherein the amount of stain blocker in the solution or dispersion is from about 2.5 g/L to about 35 g/L.

7. The method of claim 5, wherein the substrate and bath are maintained at a temperature of at least 45° C. for at least 10 minutes while the substrate is immersed.

8. The method of claim 1, wherein the dye is applied by immersing the substrate in a bath comprising a solution or dispersion of the dye.

9. The method of claim 8, wherein the amount of dye in the bath is from 0.001 to 5 percent based on the dry weight of fibers in the substrate.

10. The method of claim 8, wherein the substrate and bath are maintained at a temperature of at least 50° C. for at least 20 minutes while the substrate is immersed.

11. The method of claim 8, wherein the pH of the bath is from about 4.5 to about 8.0.

12. The method of claim 8, further comprising rinsing the substrate and drying at a temperature of at least 82° C. for at least about 15 minutes.

13. A method for reduction or elimination of dye bleeding during the treatment of a substrate, the method comprising:

a) providing a substrate consisting essentially of cationically dyeable fibers and acid dyeable fibers;

b) applying at least one stainblocker from a solution or dispersion to the substrate, wherein the stainblocker is present in an amount from about 5 to about 30% on weight fiber;

c) rinsing the stainblocker-treated substrate produced in step b);

d) applying at least one dye comprising at least one cationic dye and at least one acid dye to the rinsed substrate produced in step c); and e) fixing the dye by using dry heat to produce a dyed stainblocker-treated substrate, wherein the resulting stainblocker-treated substrate has a Gray Scale rating of at least four when compared to a substrate for which dye application preceded stainblocker application.

* * * * *